US009995537B2

(12) United States Patent
Aoki et al.

(10) Patent No.: US 9,995,537 B2
(45) Date of Patent: Jun. 12, 2018

(54) HEAT PIPE

(71) Applicant: FURUKAWA ELECTRIC CO., LTD., Tokyo (JP)

(72) Inventors: Hirofumi Aoki, Tokyo (JP); Masami Ikeda, Tokyo (JP); Yoshikatsu Inagaki, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 271 days.

(21) Appl. No.: 14/807,312

(22) Filed: Jul. 23, 2015

(65) Prior Publication Data

US 2015/0330717 A1 Nov. 19, 2015

Related U.S. Application Data

(63) Continuation of application No. PCT/JP2014/051500, filed on Jan. 24, 2014.

(30) Foreign Application Priority Data

Jan. 25, 2013 (JP) ..... 2013-012540

(51) Int. Cl.
*F28D 15/00* (2006.01)
*F28D 15/04* (2006.01)
(Continued)

(52) U.S. Cl.
CPC ..... *F28D 15/04* (2013.01); *F28D 15/0233* (2013.01); *F28D 15/046* (2013.01); *F28F 3/02* (2013.01); *F28F 2275/122* (2013.01)

(58) Field of Classification Search
CPC .... F28D 15/04; F28D 15/0233; F28D 15/046; F28F 3/02; F28F 2275/122
(Continued)

(56) References Cited

U.S. PATENT DOCUMENTS 5,076,351 A * 12/1991 Munekawa ..... F28D 15/0233 165/104.14
5,453,641 A * 9/1995 Mundinger ..... F28D 9/00 165/104.21
(Continued)

FOREIGN PATENT DOCUMENTS

JP 02-154990 A 6/1990
JP 11-190596 A 7/1999
(Continued)

OTHER PUBLICATIONS

Combined Office Action and Search Report dated Sep. 9, 2016 in Taiwanese Patent Application No. 103124531 with partial English translation and English translation of categories of cited documents.
(Continued)

*Primary Examiner* — Justin Jonaitis
(74) *Attorney, Agent, or Firm* — Oblon, McClelland, Maier & Neustadt, L.L.P.

(57) ABSTRACT

The purpose of this invention is to provide a sheet-shaped heat pipe that makes it possible to reduce a pressure loss caused by a vapor flow or a pressure loss caused by a working fluid flow to improve the maximum amount of heat to be transported and reduce thermal resistance by increasing the cross-sectional area of a vapor flow passage or a fluid flow passage, which has been limited by the length of a container in a height direction. A heat pipe (20) is provided with a protruding portion (24) so that the height of the wick-occupied portion (23) serving as the fluid flow passage is larger than the height of the space portion (22) serving as the vapor flow passage.

9 Claims, 12 Drawing Sheets

(51) Int. Cl.
*F28F 3/02* (2006.01)
*F28D 15/02* (2006.01)

(58) Field of Classification Search
USPC ..... 165/104.26, 177
See application file for complete search history.

(56) References Cited

U.S. PATENT DOCUMENTS 5,560,423 A * 10/1996 Larson ..... F28D 15/0241 165/104.26
6,082,443 A * 7/2000 Yamamoto ..... F28D 15/0233 165/104.21
6,256,201 B1 * 7/2001 Ikeda ..... F28D 15/0233 165/104.26
6,263,959 B1 * 7/2001 Ikeda ..... F28D 15/0233 165/104.26
6,269,866 B1 * 8/2001 Yamamoto ..... F28D 15/0233 165/104.26
6,317,322 B1 * 11/2001 Ueki ..... H01L 23/427 165/80.3
6,508,302 B2 1/2003 Ishida et al.
6,725,910 B2 4/2004 Ishida et al.
6,889,756 B1 * 5/2005 Hou ..... F28D 15/0233 165/104.21
7,044,201 B2 5/2006 Cho et al.
7,540,318 B2 6/2009 Nitta et al.
8,246,902 B2 8/2012 Hou
2001/0047859 A1 12/2001 Ishida et al.
2002/0056542 A1 * 5/2002 Yamamoto ..... F28D 15/0233 165/80.3
2002/0179288 A1 12/2002 Ishida et al.
2003/0180589 A1 * 9/2003 Sarraf ..... F28D 15/0233 29/890.032
2004/0040696 A1 3/2004 Cho et al.
2006/0213063 A1 * 9/2006 Lin ..... B23P 15/26 29/890.032
2006/0213647 A1 * 9/2006 Lin ..... B23P 15/26 165/104.26
2007/0272399 A1 11/2007 Nitta et al.
2009/0097265 A1 * 4/2009 Sun ..... F21V 29/004 362/373
2009/0260782 A1 * 10/2009 Whitney ..... B21D 53/02 165/104.21
2011/0179806 A1 * 7/2011 Ipposhi ..... F28D 15/0266 62/3.3
2012/0118537 A1 5/2012 Kameoka et al.

FOREIGN PATENT DOCUMENTS

JP 2000-111281 A 4/2000
JP 2001-165584 A 6/2001
JP 2004-077120 A 3/2004
JP 2006-322665 A 11/2006
JP 2011-043320 A 3/2011
JP 4714638 B2 6/2011
JP 2011-220620 A 11/2011
TW 201041492 A1 11/2010
WO WO 2013/005622 A1 1/2013

OTHER PUBLICATIONS

Office Action dated Dec. 28, 2016 in Korean Patent Application No. 10-2015-7021936 with English translation.
English Translation of the International Search Report dated Apr. 22, 2014 in PCT/JP2014/051500 filed Jan. 24, 2014.

* cited by examiner

HEAT PIPE

CROSS-REFERENCE TO PRIOR APPLICATIONS

This application is a continuation of PCT international application No. PCT/JP2014/051500 filed on Jan. 24, 2014, and which claims the benefit of priority from Japanese Patent Application No. 2013-012540, filed on Jan. 25, 2013; the entire contents of each of which are incorporated herein by reference.

TECHNICAL FIELD

The present invention relates to a heat pipe. More particularly, the invention relates to a sheet-shaped heat pipe that is used to efficiently cool heat-generating components, such as semiconductor elements (CPU, GPU, and the like), mounted in a housing of a tablet, a smartphone, a notebook PC, or the like.

BACKGROUND ART

In recent years, there is strongly required a cooling mechanism of which the size and thickness have been reduced and which is efficiently used to cool heat-generating components (components to be cooled), such as semiconductor elements (CPU, GPU, and the like) mounted in a housing, of which the size and the thickness have been reduced and the performance have been improved, of a tablet, a smartphone, a notebook PC, or the like. There is a heat pipe as one of typical cooling mechanisms.

The heat pipe is a vessel (container) such as a metal pipe that is vacuum-degassed and hermetically sealed and where condensable fluid serving as working fluid is sealed. The heat pipe automatically operates when a temperature difference occurs in the heat pipe. Working fluid, which is vaporized at a high-temperature portion (heat source side), flows to a low-temperature portion (heat-radiating side), radiates heat, and is condensed. Accordingly, the heat pipe transports heat in the form of the latent heat of the working fluid.

That is, a space, which serves as a flow passage for working fluid, is formed in the heat pipe, and working fluid received in the space is subjected to a phase change, such as vaporization or condensation, or is moved. As a result, heat is transferred. Working fluid is vaporized on the heat source side of the heat pipe by heat that is generated by components to be cooled and is transferred through the material of the container forming the heat pipe, and the vapor of the working fluid moves to the heat-radiating side of the heat pipe. The vapor of the working fluid is cooled on the heat-radiating side, and returns to a liquid-phase state again. The working fluid, which has returned to a liquid-phase state in this way, moves (returns) to the heat source side again. Heat is transferred by a phase change or the movement of the working fluid.

As the heat pipe, there are a round pipe-shaped heat pipe, a sheet-shaped heat pipe, and the like in terms of the shape of the heat pipe. A sheet-shaped heat pipe is suitably used to cool a heat-generating component that is mounted in a housing, of which the size and the thickness have been reduced and the performance have been improved, of a tablet, a smartphone, a notebook PC, or the like. The reason for this is that a sheet-shaped heat pipe is easily mounted on a heat-generating component and has a large contact surface.

A sheet-shaped heat pipe in the related art is a sheet-shaped heat pipe 900 of which the surface of a container 911 is flat as illustrated in FIGS. 14A and 14B. Meanwhile, FIGS. 14A and 14B are diagrams illustrating a heat pipe 900 that is an example of a sheet-shaped heat pipe in the related art. FIG. 14A is a schematic perspective view of the heat pipe 900, and FIG. 14B is a schematic cross-sectional view of the heat pipe 900 taken along line A-A illustrated in FIG. 14A. As illustrated in FIGS. 14A and 14B, the heat pipe 900 in the related art includes the container 911 of which peripheral portions of sheet-shaped members 911*a* and 911*b* disposed so as to face each other are joined to each other so that a hollow portion is formed in the container 911. The hollow portion of the container 911 includes wick-occupied portions 913 that are occupied by wick structures 913*a* stored and disposed in the container 911 and space portions 912 that are not occupied by the wick structures 913*a*.

Further, as another example of the sheet-shaped heat pipe of which the surface of the container in the related art is flat, there is a sheet-shaped heat pipe of which the surface of a container including a metal flat plate and a metal flat plate for a cover disposed so as to face each other is flat. This heat pipe is a planar heat pipe in which a variant cross-sectional groove including a shallow groove portion and a deep groove portion is formed at a metal flat plate portion serving as the inside of the container, the deep groove portion serves as a vapor flow passage, and the shallow groove portion serves as a fluid flow passage so that a small thickness and a large contact area can be obtained (Patent Document 1).

CITATION LIST

Patent Document

Patent Document 1: JP 2000-111281 A

DISCLOSURE OF THE INVENTION

Problem to be Solved by the Invention

However, in the sheet-shaped heat pipe in the related art of which the surface of the container is flat, the cross-sectional area of a vapor flow passage, which is a flow passage for vaporized working fluid, and the cross-sectional area of a fluid flow passage, which is a flow passage for liquid-phase working fluid, are limited by the length of the container in the height direction (in a thickness direction of the sheet-shaped heat pipe). For this reason, in the sheet-shaped heat pipe of which the size and the thickness have been reduced, the cross-sectional area of the vapor flow passage or the fluid flow passage is limited by the limitation of the length of the container in the height direction. Accordingly, a pressure loss caused by the flow of vapor vaporized from working fluid or a pressure loss caused by the flow of working fluid returning in the wick is increased in the balance of pressure in the heat pipe. As a result, there is a problem in that the reduction of the maximum amount of heat to be transported and the increase of thermal resistance are caused.

Further, it is also necessary to join fins to the sheet-shaped heat pipe by means, such as soldering, in order to improve the heat radiation efficiency of the sheet-shaped heat pipe. For example, FIGS. 16A and 16B are diagrams illustrating a heat sink 930 in the related art in which fins are joined to the sheet-shaped heat pipe. FIG. 16A is a schematic perspective view of the heat sink 930, and FIG. 16B is a schematic cross-sectional view of the heat sink 930 taken along line A-A illustrated in FIG. 16A. As illustrated in FIGS. 16A and 16B, the heat sink 930 has a structure in which a plate member 935 where a plurality of heat radiation fins 936 are joined to one surface of the flat plate member is joined to one surface of the sheet-shaped heat pipe 900 illustrated in FIGS. 14A and 14B. For this reason, since the heat sink 930 radiates the heat of the heat pipe 900 through the heat radiation fins 936 joined to the plate member 935, the heat radiation efficiency of the heat sink 930 is higher than that of a heat sink that is formed of only the heat pipe 900.

Accordingly, the invention has been made to solve the above-mentioned problem, and an object of the invention is to provide a sheet-shaped heat pipe that makes it possible to reduce a pressure loss caused by a vapor flow or a pressure loss caused by a working fluid flow to improve the maximum amount of heat to be transported and reduce thermal resistance by increasing the cross-sectional area of a vapor flow passage or a fluid flow passage, which has been limited by the length of a container in a height direction, in comparison with that in the related art.

Means for Solving Problem

The following invention is provided to solve the above-mentioned problem in the related art.

A sheet-shaped heat pipe according to a first aspect of the invention includes a container in which a hollow portion is formed, a wick structure that is stored in the container and generates a capillary force, and working fluid that is sealed in the hollow portion formed in the container. The hollow portion formed in the container includes a wick-occupied portion that is occupied by the wick structure and a space portion that is not occupied by the wick structure. A protruding portion is provided on at least a part of the wick-occupied portion and the space portion. The protruding portion is formed in a shape in which a widthwise cross-section of the protruding portion protrudes in height directions of the wick-occupied portion and the space portion, and the longitudinal direction of the protruding portion extends along the surface of the container. The protruding portion is provided so that the height of the wick-occupied portion is larger than the height of the space portion.

According to this structure, the protruding portion corresponding to the shape of a flow passage is provided on at least a part of the space portion that serves as a flow passage for vaporized working fluid (a vapor flow passage) and the wick-occupied portion that serves as a flow passage for condensed working fluid (fluid flow passage). It is possible to make the height of the vapor flow passage be different from the height of the fluid flow passage by the protruding portion. For this reason, it is possible to increase the cross-sectional area of the vapor flow passage or the fluid flow passage that has been limited by the limitation of the length of the container in the related art in the height direction. Further, it is possible to reduce a pressure loss that is caused by a vapor flow or a pressure loss that is caused by a working fluid flow by increasing the cross-sectional area of the vapor flow passage or the fluid flow passage. As a result, it is possible to improve the maximum amount of heat to be transported and to reduce thermal resistance.

Furthermore, since the protruding portion serves as a fin, the heat radiation efficiency of the heat pipe is improved in comparison with that of the sheet-shaped heat pipe in the related art of which the surface of the container is flat. Moreover, since heat radiation efficiency is improved, a fin having been joined as a separate member in the past by soldering or the like does not need to be mounted on the heat pipe. Accordingly, work cost or material cost required to mount a fin can be reduced.

Further, since it is possible to make the height of the fluid flow passage be equal to or larger than the length of the container in the height direction, it is possible to increase the cross-sectional area of the fluid flow passage, which has been limited by the limitation of the length of the container in the related art in the height direction, in the height direction. Accordingly, it is possible to reduce a pressure loss that is caused by a working fluid flow. As a result, it is possible to improve the maximum amount of heat to be transported and to reduce thermal resistance.

Furthermore, if the cross-sectional area of the vapor flow passage is increased in a lateral direction (the width direction of the vapor flow passage), that is, if a support interval of the space portion caused by the wick structure is increased when the height of the space portion serving as the vapor flow passage is the same as the height of the wick-occupied portion, which is occupied by the wick structure supporting the space portion, as in the past, a portion of the container corresponding to the space portion is significantly deformed by the atmospheric pressure. As a result, the vapor flow passage is blocked. For this reason, the cross-sectional area of the vapor flow passage cannot be increased in the lateral direction. However, according to the structure in which the height of the wick-occupied portion is made larger than the height of the space portion as in the heat pipe according to the first aspect of the invention, the blocking of the vapor flow passage caused by the deformation of the container caused by the atmospheric pressure does not occur even though the support interval of the space portion is increased. Accordingly, since it is possible to increase the cross-sectional area of the vapor flow passage in the lateral direction, it is possible to reduce a pressure loss that is caused by a vapor flow. As a result, it is possible to improve the maximum amount of heat to be transported and to reduce thermal resistance.

According to a second aspect of the invention, in the above-mentioned heat pipe according to the first aspect of the invention, the protruding portion is formed on each of both surfaces of the container that are disposed so as to face each other in a height direction.

According to a third aspect of the invention, in the above-mentioned heat pipe according to the first or second aspect of the invention, the height of a widthwise middle portion of the protruding portion is larger than the height of a bottom, from which the protruding portion starts to be raised, in the widthwise cross-section of the protruding portion.

According to a fourth aspect of the invention, in the above-mentioned heat pipe according to any one of the first to third aspects of the invention, the height of the protruding portion is increased or decreased in the longitudinal direction of the protruding portion.

When the shape of this protruding portion is employed, a difference in the pressure of vapor in the protruding portion is easily generated. That is, since vapor, which is generated when latent heat is received from a heat source, is easily diffused to a side in which the height of the protruding portion is larger, heat-diffusion performance is improved.

According to a fifth aspect of the invention, in the above-mentioned heat pipe according to any one of the first to fourth aspects of the invention, parallel protruding portions, which are a plurality of the protruding portions of which longitudinal directions are aligned in one direction and which are disposed in parallel, are formed integrally with a communication-protruding portion that is the protruding portion allowing the plurality of parallel protruding portions to communicate with one another.

According to this structure, the protruding portion serving as vapor flow passages or fluid flow passages is formed of the parallel protruding portions that are disposed in parallel and the communication-protruding portion that allow the parallel protruding portions to communicate with one another. Accordingly, vaporized working fluid or condensed working fluid moves not only in one direction of the container but also over the entire surface of the container. For this reason, since the thermal uniformity of the heat pipe is improved, heat radiation efficiency (cooling effect) is further improved.

A heat sink according to a first aspect of the invention includes the above-mentioned heat pipe according to any one of first aspect to fifth aspects of the invention and a heat radiation fin.

Effect of the Invention

The heat pipe according to the invention includes a protruding portion, which corresponds to the shape of a flow passage, on at least a part of a space portion that serves as a flow passage for vaporized working fluid (a vapor flow passage) and a wick-occupied portion that serves as a flow passage for condensed working fluid (fluid flow passage). Accordingly, it is possible to make the height of the vapor flow passage be different from the height of the fluid flow passage. For this reason, since it is possible to increase the cross-sectional area of the vapor flow passage or the fluid flow passage that has been limited by the limitation of the length of the container in the related art in the height direction, it is possible to reduce a pressure loss that is caused by a vapor flow or a pressure loss that is caused by a working fluid flow. As a result, it is possible to improve the maximum amount of heat to be transported and to reduce thermal resistance.

In particular, since it is possible to make the height of the vapor flow passage be equal to or larger than the length of the container in the height direction by making the height of the space portion be larger than the height of the wick-occupied portion, it is possible to increase the cross-sectional area of the vapor flow passage in the height direction. Accordingly, it is possible to reduce a pressure loss that is caused by a vapor flow.

Further, since it is possible to make the height of the fluid flow passage be equal to or larger than the length of the container in the height direction by making the height of the wick-occupied portion be larger than the height of the space portion, it is possible to increase the cross-sectional area of the fluid flow passage in the height direction. Accordingly, it is possible to reduce a pressure loss that is caused by a working fluid flow. Furthermore, even though the support interval of the space portion is increased, the vapor flow passage is not blocked by the deformation of the container that is caused by the atmospheric pressure. Accordingly, since the cross-sectional area of the vapor flow passage can be increased in the lateral direction, a pressure loss caused by a vapor flow can be reduced.

Moreover, since the protruding portion of the heat pipe according to the invention serve as a fin, the heat radiation efficiency of the heat pipe is improved in comparison with that of the sheet-shaped heat pipe in the related art of which the surface of a container is flat. In addition, since heat radiation efficiency is improved, a fin having been joined as a separate member in the past by soldering or the like does not need to be mounted on the heat pipe. Accordingly, work cost or material cost required to mount a fin can be reduced.

BRIEF DESCRIPTION OF DRAWINGS

FIG. 1A is a schematic perspective view of the heat pipe 10, and FIG. 1B is a schematic cross-sectional view of the heat pipe 10 taken along line A-A illustrated in FIG. 1A;

FIG. 2A is a schematic perspective view of the heat pipe 20, and FIG. 2B is a schematic cross-sectional view of the heat pipe 20 taken along line A-A illustrated in FIG. 2A;

FIG. 4A is a diagram illustrating the heat pipe 10, and FIG. 4B is a diagram illustrating the heat pipe 20;

FIG. 7A is a schematic perspective view of the heat pipe 50, and FIG. 7B is a schematic cross-sectional view of the heat pipe 50 taken along line A-A illustrated in FIG. 7A;

FIG. 12A is a schematic perspective view of the heat sink 200, and FIG. 12B is a schematic cross-sectional view of the heat sink 200 taken along line A-A illustrated in FIG. 12A;

FIG. 14A is a schematic perspective view of the heat pipe 900, and FIG. 14B is a schematic cross-sectional view of the heat pipe 900 taken along line A-A illustrated in FIG. 14A;

FIG. 16A is a schematic perspective view of the heat sink 930, and FIG. 16B is a schematic cross-sectional view of the heat sink 930 taken along line A-A illustrated in FIG. 16A.

MODE(S) FOR CARRYING OUT THE INVENTION

Embodiments of the invention will be described in detail below with reference to the drawings. Meanwhile, the description of the embodiments corresponds to examples of a heat pipe according to the invention, and is not limited thereto. The detailed structure and the like of the heat pipes according to the embodiments can be appropriately modified without departing from the scope of the invention.

Figure 1A:
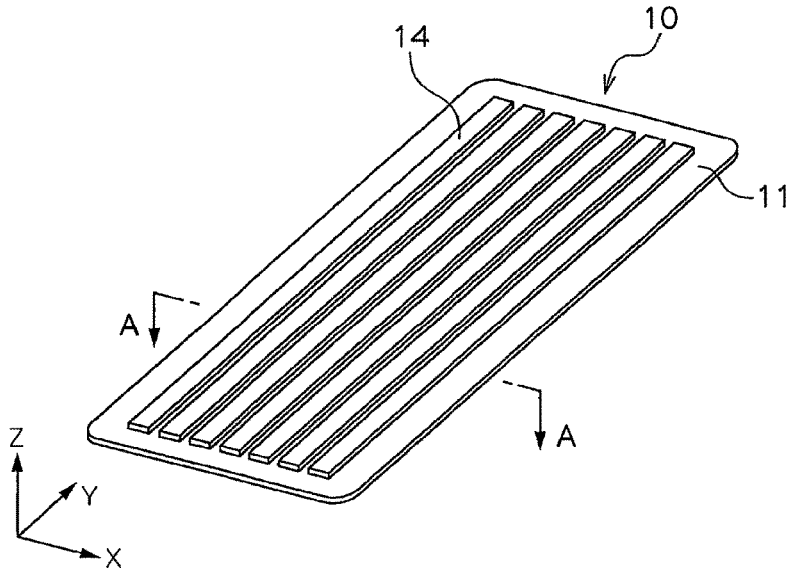
FIGS. 1A and 1B are diagrams illustrating a heat pipe 10 that is an example of a heat pipe according to a first embodiment of the invention.
Figure 1B:
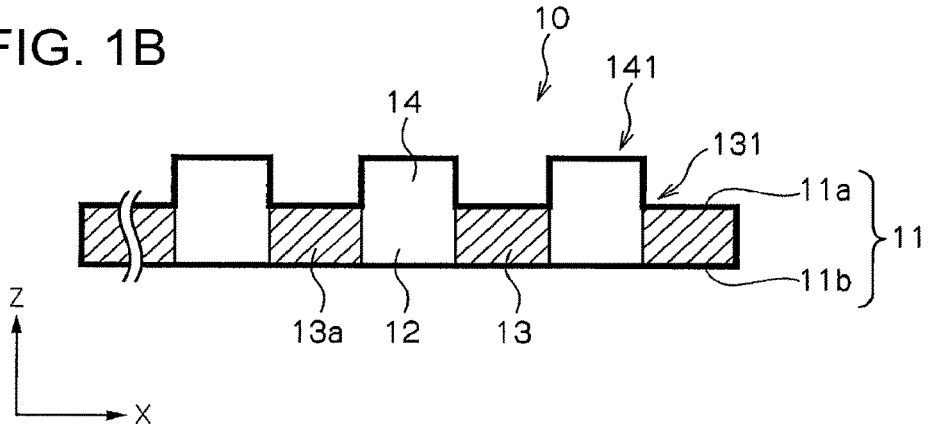

First, an example of a heat pipe according to a first embodiment of the invention will be described. FIGS. 1A and 1B are diagrams illustrating a heat pipe 10 that is an example of a heat pipe according to a first embodiment of the invention. FIG. 1A is a schematic perspective view of the heat pipe 10, and FIG. 1B is a schematic cross-sectional view of the heat pipe 10 taken along line A-A illustrated in FIG. 1A.

As illustrated in FIGS. 1A and 1B, the heat pipe 10, which is an example of a heat pipe according to a first embodiment of the invention, includes a container 11 of which peripheral portions of sheet-shaped members 11*a* and 11*b* disposed so as to face each other are joined to each other so that a hollow portion is formed in the container 11, wick structures 13*a* that are stored and disposed in the container 11 and generate capillary forces, and working fluid (not illustrated) that is sealed in the hollow portion formed in the container 11. After the wick structures 13*a* are put in the container 11 together with the working fluid and air is removed from the container 11, the container 11 is hermetically sealed. As a result, the heat pipe 10 is formed.

The hollow portion of the container 11 includes wick-occupied portions 13 that are occupied by the wick structures 13*a* stored and disposed in the container 11, and space portions 12 that are not occupied by the wick structures 13*a*. Further, the width direction of the container 11 (an X direction) is the same as the width direction of the space portion 12, and the longitudinal direction of the container 11 (a Y direction) is the same as the longitudinal direction of the space portion 12. Furthermore, the wick-occupied portions 13 and the space portions 12 are alternately disposed in the width direction of the space portion 12. Meanwhile, the width direction of the container 11 is the same as the width direction of the space portion 12 and the longitudinal direction of the container 11 is the same as the longitudinal direction of the space portion 12 in FIGS. 1A and 1B, but the width directions and the longitudinal directions are not limited thereto. For example, the longitudinal direction of the container may be the same as the width direction of the space portion and the width direction of the container may be the same as the longitudinal direction of the space portion.

The spatial structure of the space portion 12 is supported by the wick structure 13*a*, and the space portion 12 serves as a flow passage (vapor flow passage) for vaporized working fluid. Further, the wick-occupied portion 13 serves as a flow passage (fluid flow passage) for condensed working fluid by the capillary force of the wick structure 13*a*. Furthermore, the heat pipe 10 is provided with protruding portions 14 so that the height (the length in the Z direction) of the space portion 12 serving as the vapor flow passage is larger than the height of the wick-occupied portion 13 serving as the fluid flow passage.

Since the width of the protruding portion 14 (the width of the protruding portion 14 in the X direction) is substantially the same as the width of the space portion 12, the protruding portion 14 has a rectangular cross-section (a widthwise cross-section or a cross-section) protruding in the height direction (the Z direction). The longitudinal direction of the protruding portion 14 extends along the surface of the container 11 and the longitudinal direction of the space portion 12. That is, the longitudinal direction of the protruding portion 14 is the continuous direction of the protruding rectangular shape. Further, the longitudinal direction of the protruding portion 14 illustrated in FIGS. 1A and 1B is formed along the surface of the sheet-shaped member 11*a* forming the container 11 and the longitudinal direction of the space portion 12.

Since the heat pipe 10 according to the first embodiment of the invention includes the protruding portions 14 as described above, the height of the space portion 12 serving as the vapor flow passage is larger than the height of the wick-occupied portion 13 serving as the fluid flow passage. For this reason, the cross-sectional area of the space portion 12 of the heat pipe 10 is increased in the height direction in comparison with the cross-sectional area of the space portion 912 that has been limited by the limitation of the length of the container 911 of the heat pipe 900 in the related art illustrated in FIGS. 14A and 14B in the height direction. That is, since the cross-sectional area of the vapor flow passage of the heat pipe 10 according to the first embodiment of the invention is increased in the height direction in comparison with that of the heat pipe 900 in the related art, the pressure loss, which is caused by a vapor flow, of the heat pipe 10 can be reduced in comparison with that of the heat pipe 900 in the related art. As a result, it is possible to improve the maximum amount of heat to be transported and to reduce thermal resistance.

Figure 14A:
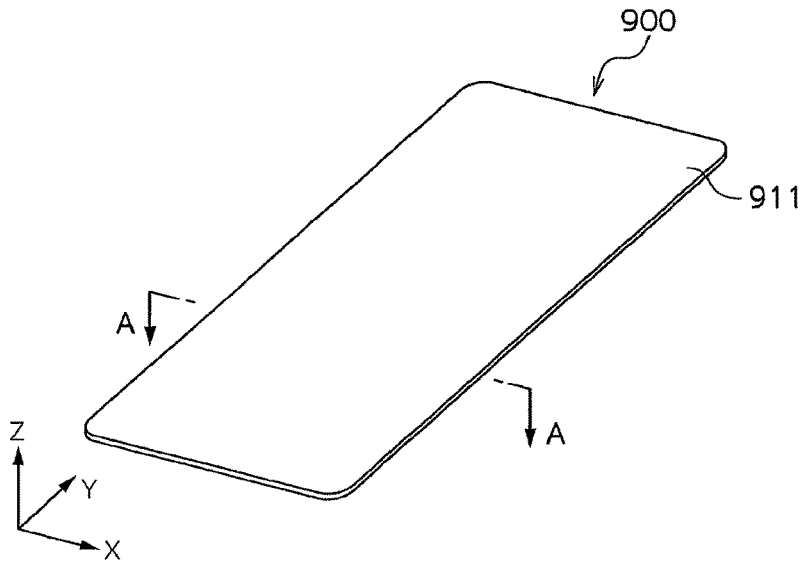
FIGS. 14A and 14B are diagrams illustrating a heat pipe 900 that is an example of a sheet-shaped heat pipe in the related art.
Figure 14B:
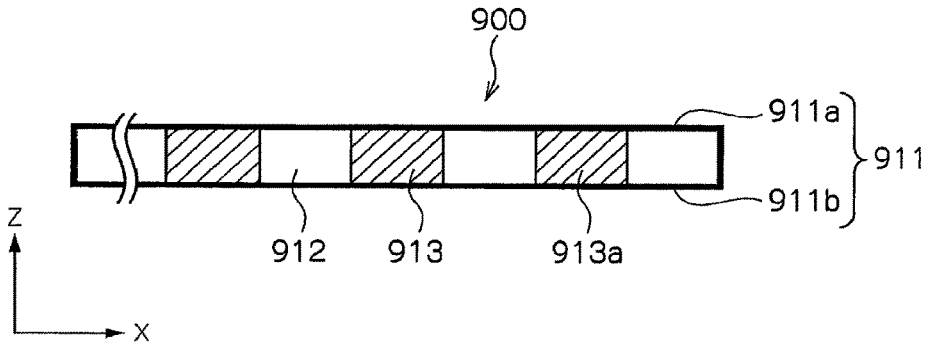

Further, since the protruding portions 14 of the heat pipe 10 according to the first embodiment of the invention serve as fins, the heat radiation efficiency of the heat pipe 10 is improved in comparison with that of the sheet-shaped heat pipe 900 in the related art of which the surface of the container 911 illustrated in FIGS. 14A and 14B is flat. Furthermore, since heat radiation efficiency is improved, fins having been joined as separate members in the past by soldering or the like do not need to be mounted on the heat pipe 10. Accordingly, work cost or material cost required to mount fins can be reduced.

Figure 2A:
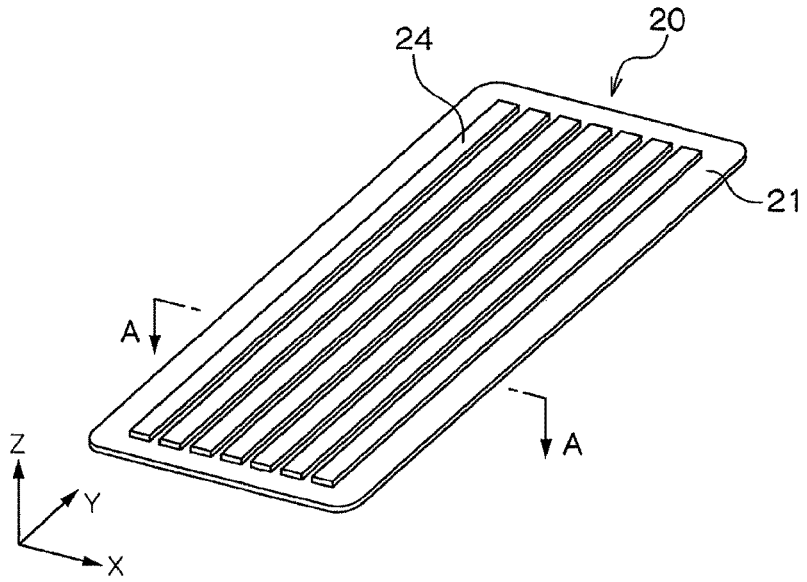
FIGS. 2A and 2B are diagrams illustrating a heat pipe 20 that is an example of a heat pipe according to a second embodiment of the invention.
Figure 2B:
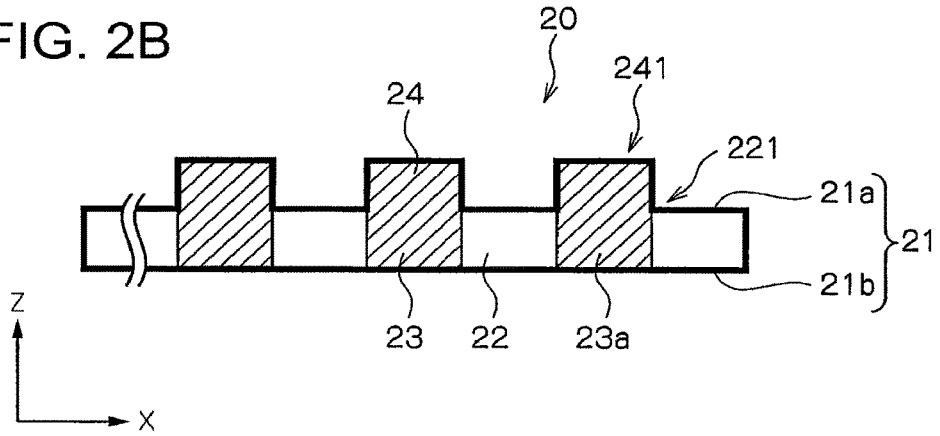

Next, an example of a heat pipe according to a second embodiment of the invention will be described. FIGS. 2A and 2B are diagrams illustrating a heat pipe 20 that is an example of a heat pipe according to a second embodiment of the invention. FIG. 2A is a schematic perspective view of the heat pipe 20, and FIG. 2B is a schematic cross-sectional view of the heat pipe 20 taken along line A-A illustrated in FIG. 2A.

As illustrated in FIGS. 2A and 2B, the heat pipe 20, which is an example of a heat pipe according to a second embodiment of the invention, includes a container 21 of which peripheral portions of sheet-shaped members 21*a* and 21*b* disposed so as to face each other are joined to each other so that a hollow portion is formed in the container 21, wick structures 23*a* that are stored and disposed in the container 21 and generate capillary forces, and working fluid (not illustrated) that is sealed in the hollow portion formed in the container 21. After the wick structures 23*a* are put in the container 21 together with the working fluid and air is removed from the container 21, the container 21 is hermetically sealed. As a result, the heat pipe 20 is formed.

The hollow portion of the container 21 includes wick-occupied portions 23 that are occupied by the wick structures 23*a* stored and disposed in the container 21, and space portions 22 that are not occupied by the wick structures 23*a*. Further, the width direction of the container 21 (the X direction) is the same as the width direction of the space portion 22, and the longitudinal direction of the container 21 (the Y direction) is the same as the longitudinal direction of the space portion 22. Furthermore, the wick-occupied portions 23 and the space portions 22 are alternately disposed in the width direction of the space portion 22. Meanwhile, the width direction of the container 21 is the same as the width direction of the space portion 22 and the longitudinal direction of the container 21 is the same as the longitudinal direction of the space portion 22 in FIGS. 2A and 2B, but the width directions and the longitudinal directions are not limited thereto. For example, the longitudinal direction of the container may be the same as the width direction of the space portion and the width direction of the container may be the same as the longitudinal direction of the space portion.

The spatial structure of the space portion 22 is supported by the wick structure 23*a*, and the space portion 22 serves as a flow passage (vapor flow passage) for vaporized working fluid. Further, the wick-occupied portion 23 serves as a flow passage (fluid flow passage) for condensed working fluid by the capillary force of the wick structure 23*a*. Furthermore, the heat pipe 20 is provided with protruding portions 24 so that the height (the length in the Z direction) of the wick-occupied portion 23 serving as the fluid flow passage is larger than the height of the space portion 22 serving as the vapor flow passage.

Since the width of the protruding portion 24 (the width of the protruding portion 24 in the X direction) is substantially the same as the width of the wick-occupied portion 23, the protruding portion 24 has a rectangular cross-section (a widthwise cross-section or a cross-section) protruding in the height direction (the Z direction). The longitudinal direction of the protruding portion 24 extends along the surface of the container 21 and the longitudinal direction of the wick-occupied portion 23. That is, the longitudinal direction of the protruding portion 24 is the continuous direction of the protruding rectangular shape. Further, the longitudinal direction of the protruding portion 24 illustrated in FIGS. 2A and 2B is formed along the surface of the sheet-shaped member 21*a* forming the container 21 and the longitudinal direction of the wick-occupied portion 23.

Since the heat pipe 20 according to the second embodiment of the invention includes the protruding portions 24 as described above, the height of the wick-occupied portion 23 serving as the fluid flow passage is larger than the height of the space portion 22 serving as the vapor flow passage. For this reason, the cross-sectional area of the wick-occupied portion 23 of the heat pipe 20 is increased in the height direction in comparison with the cross-sectional area of the wick-occupied portion 913 that has been limited by the limitation of the length of the container 911 of the heat pipe 900 in the related art illustrated in FIGS. 14A and 14B in the height direction. That is, since the cross-sectional area of the fluid flow passage of the heat pipe 20 according to the second embodiment of the invention is increased in the height direction in comparison with that of the heat pipe 900 in the related art, the pressure loss, which is caused by a working fluid flow, of the heat pipe 20 can be reduced in comparison with that of the heat pipe 900 in the related art. As a result, it is possible to improve the maximum amount of heat to be transported and to reduce thermal resistance.

Figure 15:
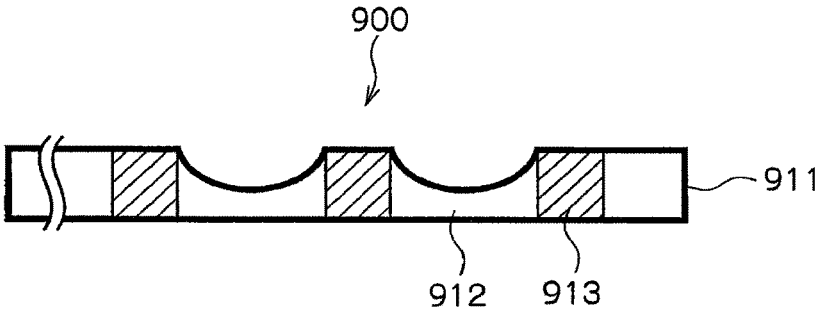
FIG. 15 is a diagram illustrating the deformation of a container 911 of the heat pipe 900 that is caused by the atmospheric pressure.
Figure 16A:
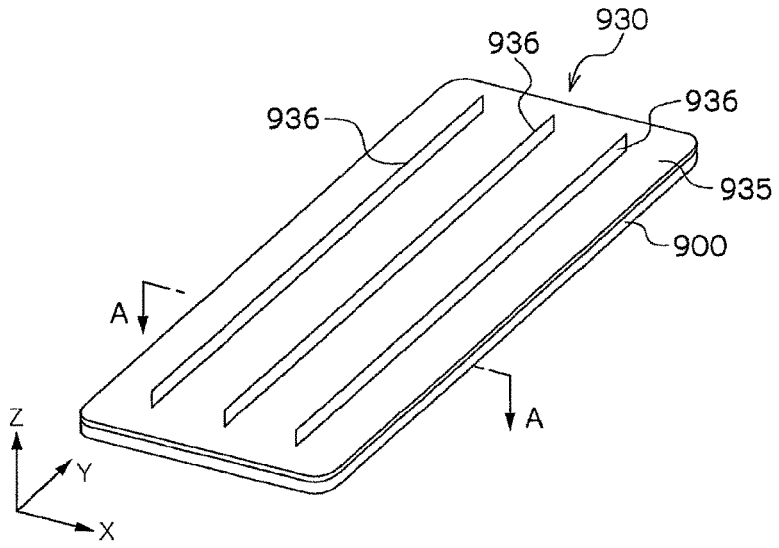
FIGS. 16A and 16B are diagrams illustrating a heat sink 930 in the related art in which fins are joined to the sheet-shaped heat pipe.
Figure 16B:
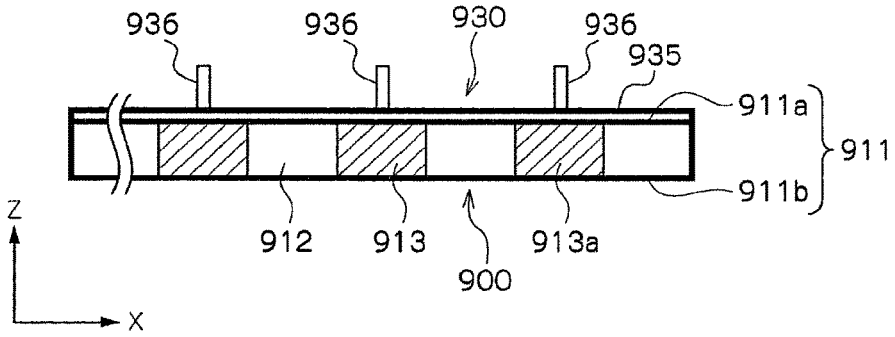

Further, as illustrated in FIGS. 14A and 14B, the height of the space portion 912, which serves as the vapor flow passage, is the same as the height of the wick-occupied portion 913, which is occupied by the wick structure 913*a* supporting the space portion 912, in the heat pipe 900 in the related art. When the cross-sectional area of each space portion 912 (vapor flow passage) is increased in a lateral direction (the X direction) in the structure in the related art, that is, when a support interval of the space portion 912 is increased, portions of the container 911 corresponding to the space portions 912 are significantly deformed by the atmospheric pressure as illustrated in FIG. 15. As a result, the vapor flow passages are blocked. For this reason, the cross-sectional area of the vapor flow passage of the heat pipe 900 in the related art could not be increased in the lateral direction.

Figure 3:
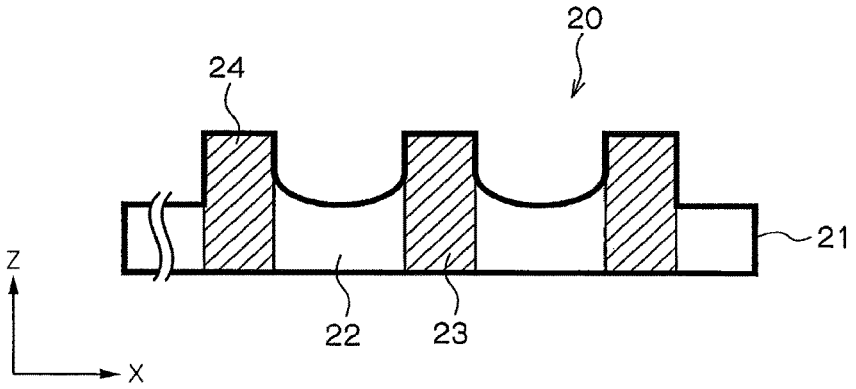
FIG. 3 is a diagram illustrating the deformation of a container 21 of the heat pipe 20 that is caused by the atmospheric pressure.

However, since the heat pipe 20 according to the second embodiment of the invention includes the protruding portions 24 as described above, the height of the wick-occupied portion 23 serving as the fluid flow passage is larger than the height of the space portion 22 serving as the vapor flow passage. For this reason, even though the support interval of the space portion 22 is increased, that is, even though the cross-sectional area of the space portion 22 (vapor flow passage) is increased in the lateral direction (the X direction), the space portions 22 serving as the vapor flow passages are not blocked by the deformation of the container 21 that is caused by the atmospheric pressure as illustrated in FIG. 3. Accordingly, since the cross-sectional area of the vapor flow passage of the heat pipe 20 according to the second embodiment of the invention can be increased in the lateral direction in comparison with that of the heat pipe 900 in the related art, a pressure loss caused by a vapor flow can be reduced. As a result, it is possible to improve the maximum amount of heat to be transported and to reduce thermal resistance.

Further, since the protruding portions 24 of the heat pipe 20 according to the second embodiment of the invention serve as fins, the heat radiation efficiency of the heat pipe 20 is improved in comparison with that of the sheet-shaped heat pipe 900 in the related art of which the surface of the container 911 illustrated in FIGS. 14A and 14B is flat. Furthermore, since heat radiation efficiency is improved, fins having been joined as separate members in the past by soldering or the like do not need to be mounted on the heat pipe 20. Accordingly, work cost or material cost required to mount fins can be reduced.

Figure 4A:
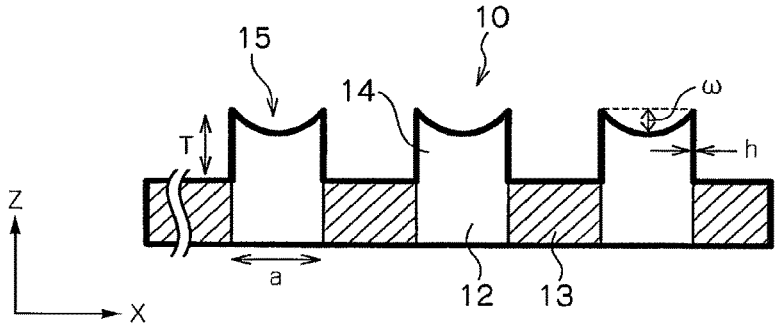
FIGS. 4A and 4B are diagrams illustrating a relationship between the height of a protruding portion and the amount of the deformation of a container of a heat pipe that is caused by the atmospheric pressure.
Figure 4B:
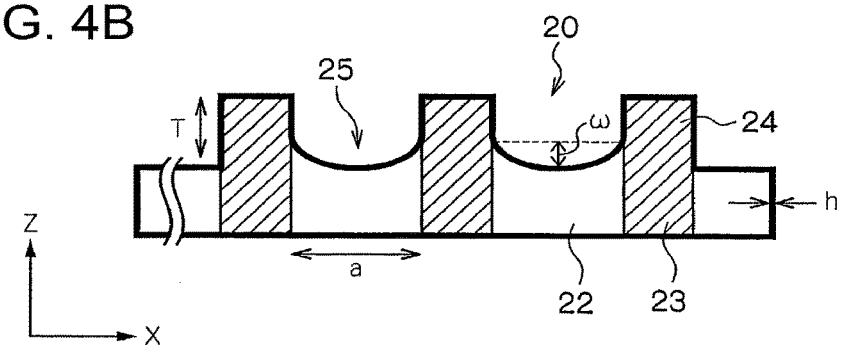

Since the internal pressure of the heat pipes 10 and 20 is lower than the external pressure (atmospheric pressure) of the above-mentioned heat pipes 10 and 20 of the invention, portions 15 and 25 of the containers 11 and 21 corresponding to top sides of the space portions 12 and 22 are deformed by the atmospheric pressure as illustrated in FIGS. 4A and 4B. To prevent the space portions 12 and 22, which serve as the vapor flow passages, from being blocked by this deformation, it is preferable that the heat pipes 10 and 20 of the invention are adapted to satisfy the following expressions (1) and (2).

$$T > \omega = 0.14 \times \frac{(P_0 - P)a^4}{Eh^3} \quad (1)$$

$$0.05 \times 10^{-3} \leq h \leq 3 \times 10^{-3} \quad (2)$$

Here, T (unit: m) denotes the height of each of the protruding portions 14 and 24, ω (unit: m) denotes the maximum amount of the deformation of each of the portions 15 and 25 of the containers 11 and 21 corresponding to the top sides of the space portions 12 and 22, $P_0$ (unit: Pa) denotes the atmospheric pressure, P (unit: Pa) denotes the internal pressure of each of the heat pipes 10 and 20, a (unit: m) denotes the distance between the adjacent wick structures (the length of each of the space portions 12 and 22 in the X direction), h (unit: m) denotes the thickness of each of the containers 11 and 21, and E (unit: Pa) denotes the modulus of longitudinal elasticity of each of the containers 11 and 21.

Since the heat pipes 10 and 20 of the invention are adapted to satisfy the relational expressions (1) and (2), it is possible to increase the cross-sectional areas of the space portions 12 and 22, which serve as the vapor flow passages, without the occurrence of the blocking of the space portions 12 and 22 that is caused by the deformation of the containers 11 and 21. As a result, since it is possible to reduce a pressure loss that is caused by a vapor flow, it is possible to improve the maximum amount of heat to be transported and to reduce thermal resistance.

Figure 5:
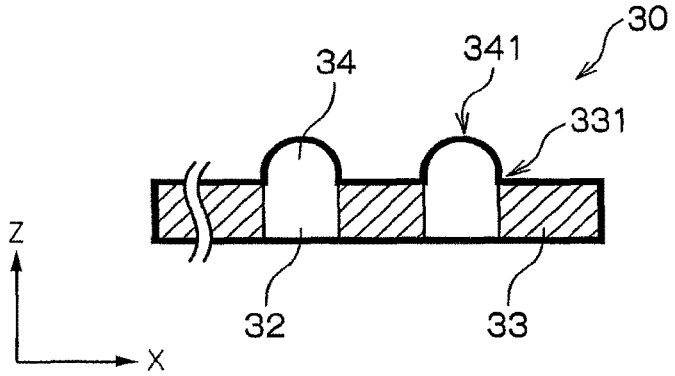
FIG. 5 is a schematic cross-sectional view of a heat pipe 30 that is an example of a heat pipe according to another embodiment of the invention.
Figure 6:
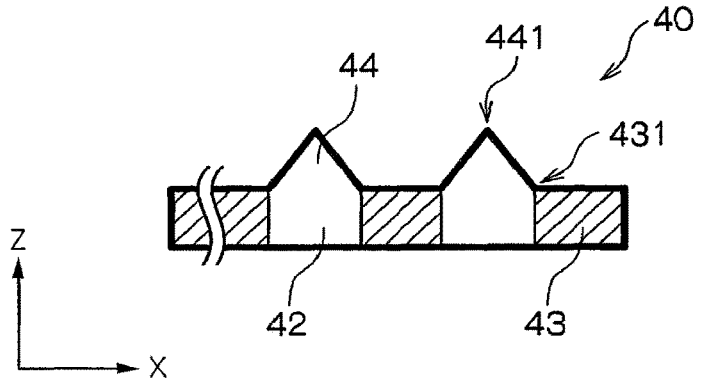
FIG. 6 is a schematic cross-sectional view of a heat pipe 40 that is an example of a heat pipe according to another embodiment of the invention.

Further, the cross-sectional shapes of the protruding portions 14 and 24 of the above-mentioned heat pipes 10 and 20 of the invention are rectangular shapes, but the cross-sectional shape of the protruding portion of the heat pipe according to the invention is not limited to a rectangular shape. FIGS. 5 and 6 are schematic cross-sectional views (widthwise cross-sectional views) of heat pipes 30 and 40 that are examples of heat pipes according to other embodiments of the invention. As illustrated in FIG. 5, the cross-sectional shape of a protruding portion 34 may be an arc shape. Furthermore, as illustrated in FIG. 6, the cross-sectional shape of a protruding portion 44 may be a triangular shape. Meanwhile, FIGS. 5 and 6 illustrate cases in which space portions 32 and 42 of the heat pipes 30 and 40 are provided with the protruding portions 34 and 44. However, even when the wick-occupied portion of the heat pipe is provided with the protruding portion as illustrated in FIG. 2B, the cross-sectional shape of the protruding portion may be an arc shape or a triangular shape as illustrated in FIGS. 5 and 6.

It is preferable that the height of a middle portion of the protruding portion is larger than the height of a bottom from which the protruding portion starts to be raised. Here, the middle portion of the protruding portion is a top side portion 141 of the protruding portion 14 of FIG. 1B, atop side portion 241 of the protruding portion 24 of FIG. 2B, the highest portion 341 of the arc-shaped protruding portion 34 of FIG. 5, and a vertex portion 441 of the triangular protruding portion 44 of FIG. 6. Further, the bottom from which the protruding portion starts to be raised is a portion 131 of the wick-occupied portion 13 of FIG. 1B, a portion 221 of the space portion 22 of FIG. 2B, a portion 331 of a wick-occupied portion 33 of FIG. 5, and a portion 431 of a wick-occupied portion 43 of FIG. 6.

As described above, the protruding portion of the heat pipe according to the embodiment of the invention is adapted to have an optimal cross-sectional shape in accordance with the shape of a space in a housing in which the heat pipe is disposed and the disposition of components to be cooled. Accordingly, the large cross-sectional area of the space portion serving as the vapor flow passage or the large cross-sectional area of the wick-occupied portion serving as the fluid flow passage is ensured. As a result, it is possible to reduce a pressure loss that is caused by a vapor flow or a pressure loss that is caused by a working fluid flow.

Figure 7A:
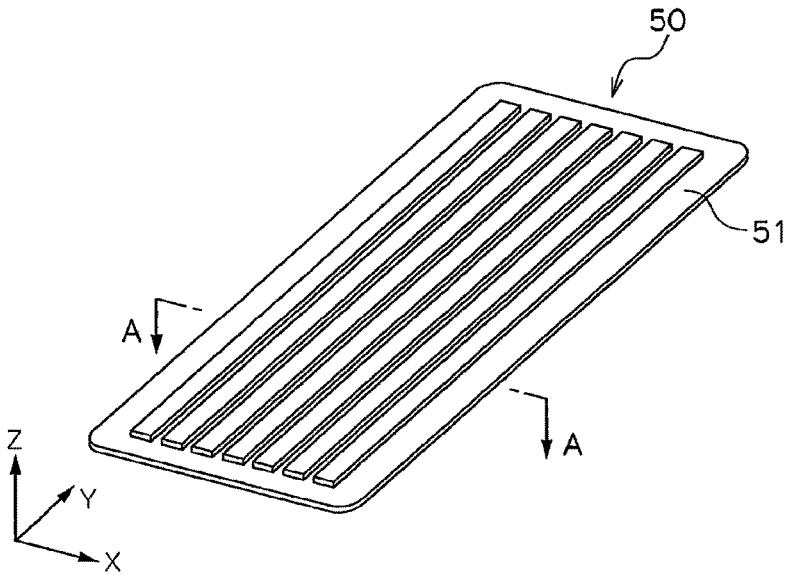
FIGS. 7A and 7B are diagrams illustrating a heat pipe 50 that is an example of a heat pipe according to another embodiment of the invention.
Figure 7B:
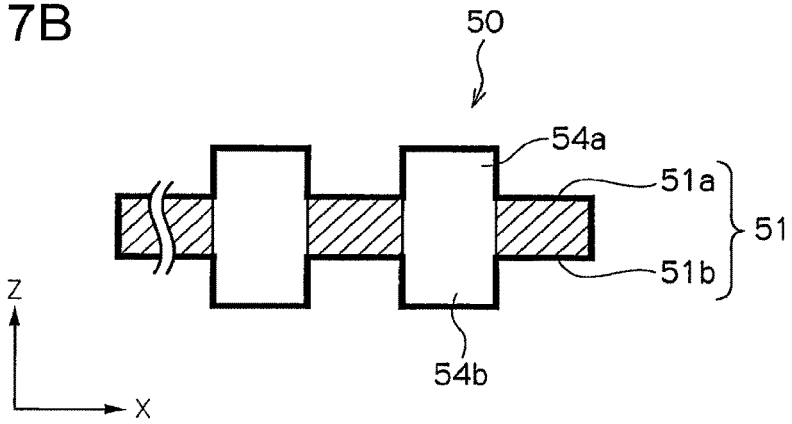

Furthermore, the protruding portions 14 and 24 of the above-mentioned heat pipes 10 and 20 of the invention are provided on the sheet-shaped members 11*a* and 21*a*, which form the containers 11 and 21, as illustrated in FIGS. 1B and 2B, but each of the two sheet-shaped members, which form the container and are disposed so as to face each other, may be provided with protruding portions. FIGS. 7A and 7B are diagrams illustrating a heat pipe 50 that is an example of a heat pipe according to another embodiment of the invention. FIG. 7A is a schematic perspective view of the heat pipe 50, and FIG. 7B is a schematic cross-sectional view of the heat pipe 50 taken along line A-A illustrated in FIG. 7A. As illustrated in FIGS. 7A and 7B, sheet-shaped members 51*a* and 51*b*, which form a container 51, are provided with protruding portions 54*a* and 54*b* in the heat pipe 50. Further, the cross-sectional shape of each of the protruding portions 54*a* and 54*b* is a rectangular shape, and the protruding portions 54*a* and 54*b* are formed so as to have the same longitudinal direction.

Figure 8:
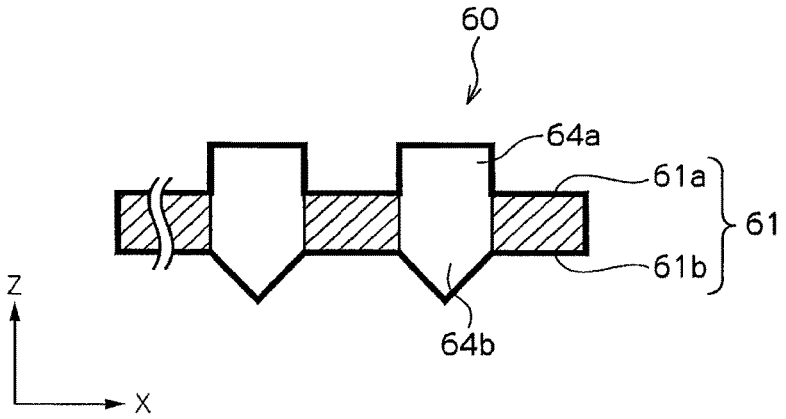
FIG. 8 is a schematic cross-sectional view of a heat pipe 60 that is an example of a heat pipe according to another embodiment of the invention.

The cross-sectional shape of each of the protruding portions 54*a* and 54*b* is a rectangular shape in FIGS. 7A and 7B, but the cross-sectional shapes of the protruding portions of the two sheet-shaped members, which form the container and are disposed so as to face each other, may be different from each other. FIG. 8 illustrates a heat pipe 60 that is an example thereof. In the heat pipe 60, one sheet-shaped member 61*a* forming a container 61 is provided with protruding portions 64*a* having a rectangular cross-section and the other sheet-shaped member 61*b* forming the container 61 is provided with protruding portions 64*b* having a triangular cross-section.

Figure 9:
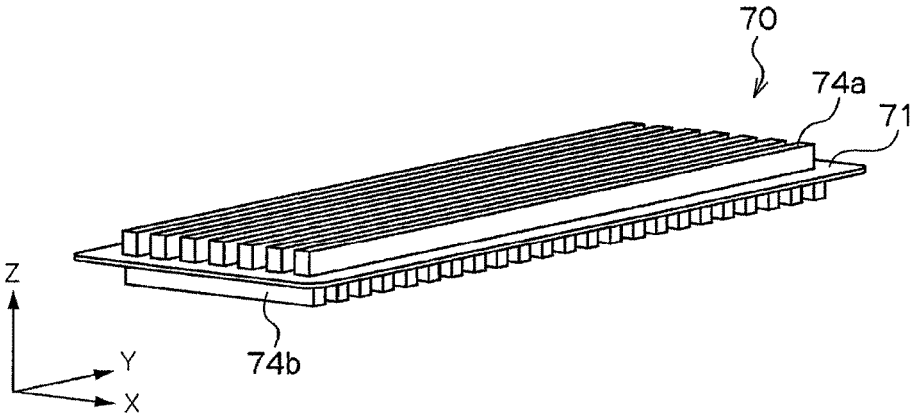
FIG. 9 is a schematic perspective view of a heat pipe 70 that is an example of a heat pipe according to another embodiment of the invention.

Further, the protruding portions 54*a* and 54*b* are formed so as to have the same longitudinal direction in FIGS. 7A and 7B, but the longitudinal directions of the protruding portions of the two sheet-shaped members, which are disposed so as to face each other, may be different from each other. FIG. 9 illustrates a heat pipe 70 that is an example thereof. In the heat pipe 70, the longitudinal direction of protruding portions 74*a* formed on one surface of a container 71 is parallel to the longitudinal direction of the container (the Y direction) and the longitudinal direction of protruding portions 74*b* formed on the other surface of the container 71 is parallel to the width direction of the container (the X direction).

The flows of air (wind directions) in the housing in which the heat pipe according to the invention is disposed are various, that is, are the same or different from each other on both upper and lower surfaces of the heat pipe (in the Z direction). When the longitudinal directions of the protruding portions are set to the same direction or different directions on both the upper and lower surfaces of the heat pipe (in the Z direction) in accordance with the wind directions on the respective upper and lower surfaces of the heat pipe in the housing as described above, the effect of the protruding portions as fins is improved. Accordingly, heat radiation efficiency is improved.

Figure 10:
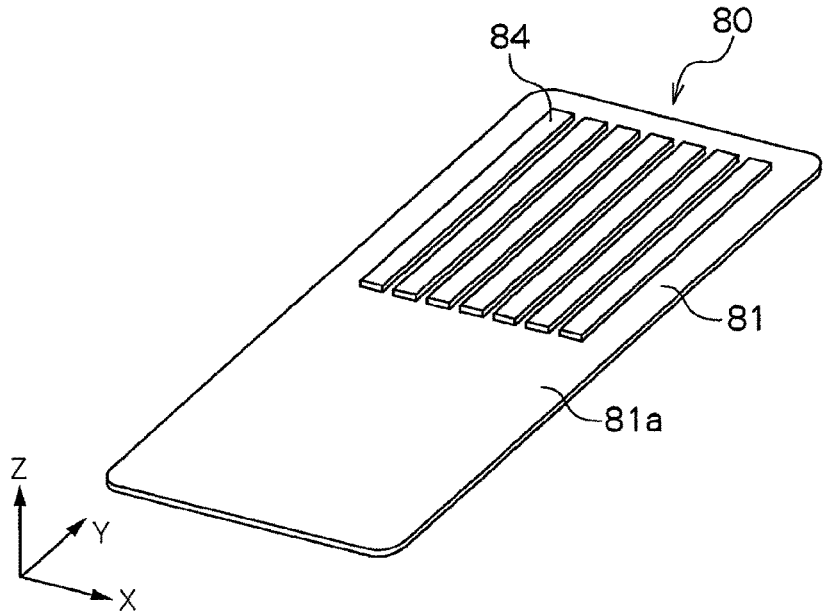
FIG. 10 is a schematic perspective view of a heat pipe 80 that is an example of a heat pipe according to another embodiment of the invention.

The protruding portions 14 and 24 of the above-mentioned heat pipes 10 and 20 of the invention are provided on the entire surfaces of the sheet-shaped members 11*a* and 21*a* that form the containers 11 and 21 as illustrated in FIGS. 1A and 2A, but may be provided on a part of the surfaces of the sheet-shaped members. FIG. 10 is a schematic perspective view of a heat pipe 80 that is an example of a heat pipe according to another embodiment of the invention. Protruding portions 84 of the heat pipe 80 are provided on a part of a sheet-shaped member 81*a* that forms a container 81 as illustrated in FIG. 10.

Figure 11:
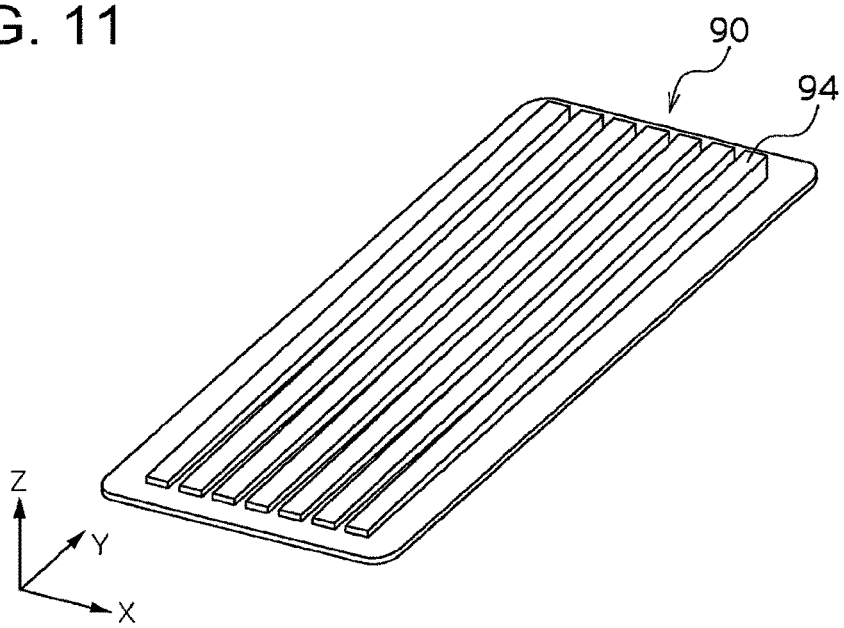
FIG. 11 is a schematic perspective view of a heat pipe 90 that is an example of a heat pipe according to another embodiment of the invention.

Further, in the above-mentioned heat pipes 10 and 20 of the invention, the heights of the protruding portions 14 and 24 are constant in the longitudinal directions of the protruding portions 14 and 24 as illustrated in FIGS. 1A and 2A. However, the height of the protruding portion may be increased or decreased in the longitudinal direction of the protruding portion. FIG. 11 is a schematic perspective view of a heat pipe 90 that is an example of a heat pipe according to another embodiment of the invention. As illustrated in FIG. 11, protruding portions 94 of the heat pipe 90 are provided so that the height of the protruding portion 94 is increased (or decreased) in the longitudinal direction of the protruding portion 94 (the Y direction).

When a space portion is provided with the protruding portion 94 of which the height is increased (or decreased) in the longitudinal direction (the Y direction) as illustrated in FIG. 11, the heat pipe 90 of the invention is disposed in the housing so that a side on which the height of the protruding portion 94 is small corresponds to a heat source side and a side on which the height of the protruding portion 94 is large corresponds to a heat-radiating side. Accordingly, since vapor easily moves to the heat-radiating side from the heat source side, it is possible to reduce a pressure loss that is caused by a vapor flow. As a result, it is possible to improve the maximum amount of heat to be transported. Furthermore, when a wick-occupied portion is provided with the protruding portion 94 of which the height is increased (or decreased) in the longitudinal direction (the Y direction), the heat pipe 90 of the invention is disposed in the housing so that a side on which the height of the protruding portion 94 is large corresponds to a heat source side and a side on which the height of the protruding portion 94 is small corresponds to a heat-radiating side. Accordingly, since condensed working fluid easily returns to the heat source side from the heat-radiating side, it is possible to reduce a pressure loss that is caused by a working fluid flow. As a result, it is possible to improve the maximum amount of heat to be transported.

As described above, each of the heat pipes according to the embodiments of the invention described in FIGS. 1A to 11 is formed so that the protruding portions are adapted to have an optimal shape or to be optimally disposed in accordance with the shape of the space and an environmental condition in the housing and the disposition of components to be cooled, and is disposed in the housing. Accordingly, it is possible to increase the cross-sectional area of the vapor flow passage or the fluid flow passage that has been limited by the limitation of the length of the container in the related art in the height direction. Therefore, it is possible to reduce a pressure loss that is caused by a vapor flow or a pressure loss that is caused by a working fluid flow. As a result, it is possible to improve the maximum amount of heat to be transported and to reduce thermal resistance.

Further, since the protruding portions of the heat pipe according to the embodiment of the invention serve as fins, the heat radiation efficiency of the heat pipes is improved in comparison with that of the sheet-shaped heat pipe in the related art of which the surface of the container is flat. Furthermore, since heat radiation efficiency is improved, fins having been joined as separate members in the past by soldering or the like do not need to be mounted on the heat pipe. Accordingly, work cost or material cost required to mount fins can be reduced.

Figure 12A:
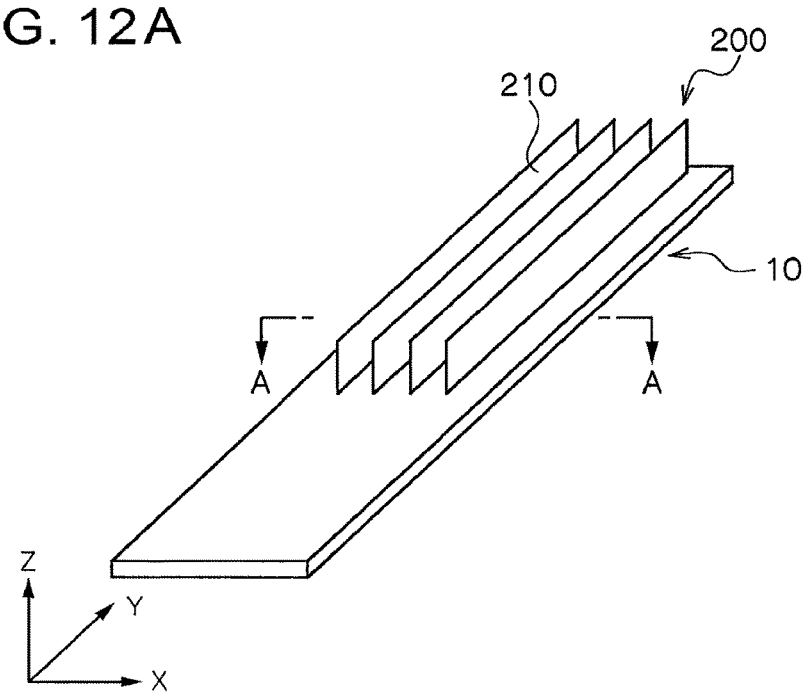
FIGS. 12A and 12B are diagrams illustrating a heat sink 200 that is an example of a heat sink according to an embodiment of the invention.
Figure 12B:
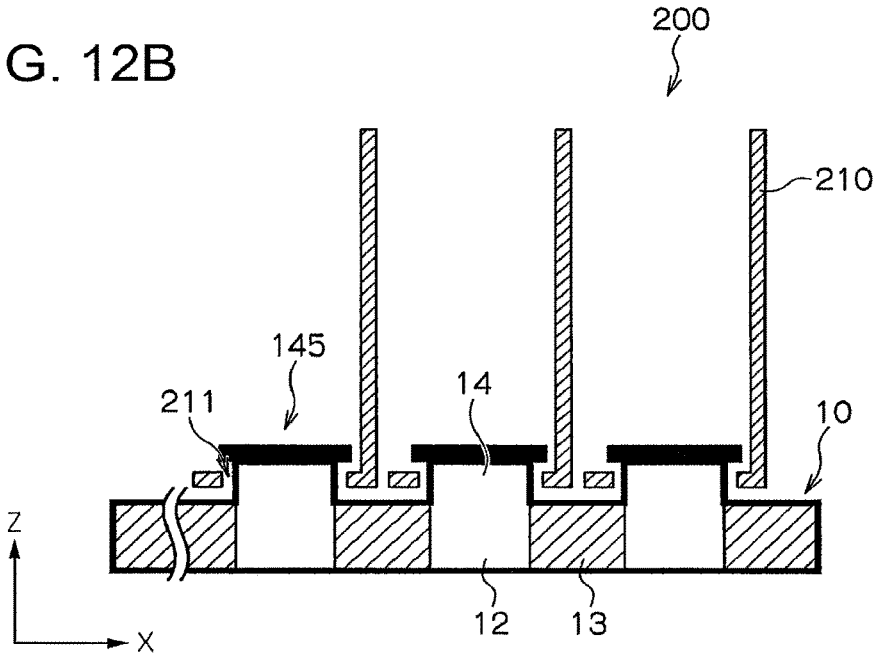

Next, a heat sink according to an embodiment of the invention, which includes the heat pipe according to the embodiment of the invention described in FIGS. 1A to 11 and heat radiation fins, will be described. FIGS. 12A and 12B are diagrams illustrating a heat sink 200 that is an example of a heat sink according to an embodiment of the invention. FIG. 12A is a schematic perspective view of the heat sink 200, and FIG. 12B is a schematic cross-sectional view of the heat sink 200 taken along line A-A illustrated in FIG. 12A. Here, the heat pipe 10 will be described as an example of the heat pipe according to the embodiment of the invention, but any one of the heat pipes according to the embodiments of the invention described in FIGS. 1A to 11 may be used.

As illustrated in FIGS. 12A and 12B, the heat sink 200, which is an example of a heat sink according to an embodiment of the invention, includes the sheet-shaped heat pipe 10 and heat radiation fins 210. The heat radiation fin 210 includes a hole 211 to which at least a part of the protruding portion 14 of the heat pipe 10 is fitted. After the protruding portion 14 of the heat pipe 10 is fitted to the hole 211, a method such as caulking is performed on a top side portion 145 of the protruding portion 14. As a result, the heat radiation fin 210 is fixed to the heat pipe 10.

As described above, in the heat sink 200 according to the embodiment of the invention, the heat radiation fins 210 can be fixed to the heat pipe 10 by caulking work that is simpler than soldering work. Further, it is possible to further improve heat radiation efficiency by joining the heat radiation fins 210 to the heat pipe according to the embodiment of the invention of which the heat radiation efficiency is higher than the heat radiation efficiency of the sheet-shaped heat pipe in the related art.

Figure 13:
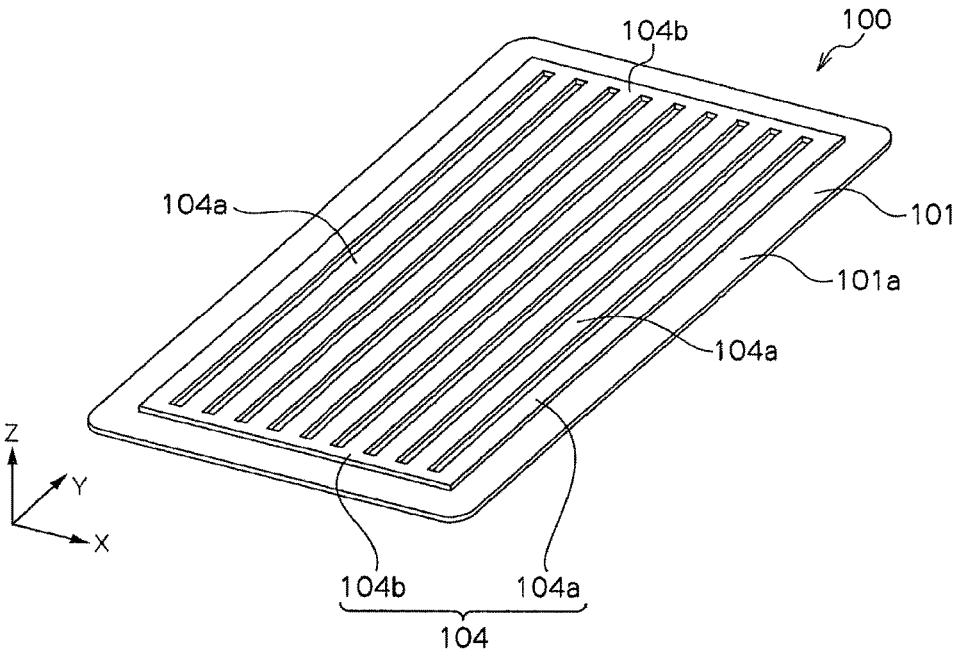
FIG. 13 is a schematic perspective view of a heat pipe 100 that is an example of a heat pipe according to another embodiment of the invention.

In the above-mentioned heat pipes 10 and 20 of the invention, the plurality of protruding portions 14 and 24 are independently provided in parallel on the surfaces of the sheet-shaped members 11*a* and 21*a* as illustrated in FIGS. 1A and 2A. However, the plurality of protruding portions may be formed on the surface of the sheet-shaped member so as to communicate with each other. FIG. 13 is a schematic perspective view of a heat pipe 100 that is an example of a heat pipe according to another embodiment of the invention. In the heat pipe 100, a protruding portion 104 is provided on the surface of a sheet-shaped member 101*a* forming a container 101 as illustrated in FIG. 13. The protruding portion 104 includes a plurality of parallel protruding portions 104*a* of which longitudinal directions are aligned in one direction and which are disposed in parallel and communication-protruding portions 104*b* that allow the plurality of parallel protruding portions 104*a* to communicate with one another, and the parallel protruding portions 104*a* are formed integrally with the communication-protruding portions 104*b*.

Meanwhile, in FIG. 13, the protruding portion 104 is formed so that the longitudinal direction of the parallel protruding portion 104*a* is parallel to the longitudinal direction of the container 101 (the Y direction) and the longitudinal direction of the communication-protruding portion 104*b* is parallel to the width direction of the container 101 (the X direction). However, the protruding portion 104 may be formed so that the longitudinal direction of the parallel protruding portion 104*a* is parallel to the width direction of the container 101 (the X direction) and the longitudinal direction of the communication-protruding portion 104*b* is parallel to the longitudinal direction of the container 101 (the Y direction). That is, the protruding portion 104 may include parallel protruding portions 104*a* of which longitudinal directions are aligned in one direction and which are disposed in parallel and communication-protruding portions

104*b* that allow the parallel protruding portions 104*a* to communicate with one another, and the parallel protruding portions 104*a* may be formed integrally with the communication-protruding portions 104*b*.

The heat pipe 100 according to another embodiment of the invention also obtains the following effects in addition to effects that are obtained by the heat pipes according to the embodiments of the invention described in FIGS. 1A to 11. As described above, the protruding portion 104, which serves as vapor flow passages or fluid flow passages, of the heat pipe 100 according to another embodiment of the invention includes the parallel protruding portions 104*a* that are disposed in parallel and the communication-protruding portions 104*b* that allow the parallel protruding portions 104*a* to communicate with one another. For this reason, vaporized working fluid or condensed working fluid moves not only in the longitudinal direction of the container 101 (the Y direction) but also in the width direction of the container 101 (the X direction). That is, vaporized working fluid or condensed working fluid moves not only in one direction of the container 101 but also over the entire surface of the container 101. As a result, since the thermal uniformity of the heat pipe 100 is improved, heat radiation efficiency (cooling effect) is further improved.

Further, it is also possible to further improve heat radiation efficiency by providing heat radiation fins on the above-mentioned heat pipe 100 as in a heat sink illustrated in FIG. 12.

Meanwhile, the heat pipe according to the embodiment of the invention includes the container and working fluid that is provided in the container. The container is made of a thermal conductive material, and is preferably made of an aluminum-based material or a copper-based material.

Furthermore, since thermal conductivity is improved when a wick material is provided in the container, it is preferable that a wick material is provided in the container. A mesh material, a sintered material, or a planar material woven with metal wires may be preferably used as the wick material. Further, it is preferable that water, Freon, or the like is used as the working fluid. A general joining technique may be used for the welding of an end portion of the container, but it is preferable that laser welding, braze welding, or diffusion joining is used.

EXPLANATIONS OF LETTERS OR NUMERALS

10, 20, 30, 40, 50, 60, 70, 80, 90, 100: heat pipe
11, 21, 51, 61, 71, 81, 101: container
12, 22, 32, 42: space portion
13, 23, 33, 43: wick-occupied portion
13*a*, 23*a*: wick structure
14, 24, 34, 44, 54*a*, 54*b*, 64*a*, 64*b*, 74*a*, 74*b*, 84, 94, 104: protruding portion
104*a*: parallel protruding portion (protruding portion)
104*b*: communication-protruding portion (protruding portion)
200: heat sink
210: heat radiation fins

The invention claimed is:

1. A sheet-shaped heat pipe comprising:
a container in which a hollow portion is formed;
a wick structure that is stored in the container and generates a capillary force; and
working fluid that is sealed in the hollow portion formed in the container,
wherein the hollow portion formed in the container includes a wick-occupied portion that is entirely occupied by the wick structure, and a space portion that is not occupied by the wick structure,
a protruding portion formed in the container as part of the wick-occupied portion and having a shape in which a widthwise cross-section of the protruding portion protrudes in a height direction of the wick-occupied portion, and a longitudinal direction of the protruding portion extends along the surface of the container, and
the protruding portion is provided so that the height of the wick-occupied portion is larger than the height of the space portion, wherein the height, T, of the protruding portion satisfies $$T > \omega = 0.14x\frac{(P_0 - P)a^4}{Eh^3},$$

where $0.05\times10^{-3} \leq h \leq 3\times10^{-3}$, and
T in meters is the height of the protruding portion, ω in meters is a maximum amount of deformation of a top side of the space portion, and a in meters is a distance between the wick-occupied portion and a next wick-occupied portion, $P_0$ in pascals is the atmospheric pressure, P in pascals is the internal pressure of each of the heat pipe, E in pascals is the modulus of longitudinal elasticity of the container, and h in meters is the thickness of the container,
the space portion being interposed between the wick-occupied portion and the next wick-occupied portion.

2. The heat pipe according to claim 1,
wherein the protruding portion is formed on each of both surfaces of the container that are disposed so as to face each other in a height direction.

3. The heat pipe according to claim 1,
wherein the height of a widthwise middle portion of the protruding portion is larger than the height of a bottom, from which the protruding portion starts to be raised, in the widthwise cross-section of the protruding portion.

4. The heat pipe according to claim 1 or 2,
wherein the height of the protruding portion is increased or decreased in the longitudinal direction of the protruding portion.

5. The heat pipe according to claim 1 or 2,
wherein parallel protruding portions, which are a plurality of the protruding portions of which longitudinal directions are aligned in one direction and which are disposed in parallel, are formed integrally with a communication-protruding portion that is the protruding portion allowing the plurality of parallel protruding portions to communicate with one another.

6. A heat sink comprising:
the heat pipe according to claim 1 or 2 and
a heat radiation fin.

7. A heat sink comprising:
the heat pipe according to claim 3 and
a heat radiation fin.

8. A heat sink comprising:
the heat pipe according to claim 4 and
a heat radiation fin.

9. A heat sink comprising:
the heat pipe according to claim 5 and
a heat radiation fin.

* * * * *